US005595544A

United States Patent [19]

Roelke

[11] Patent Number: 5,595,544

[45] Date of Patent: Jan. 21, 1997

[54] PUTTER GRIP WITH STABILIZING MEMBERS

[76] Inventor: Harold R. Roelke, 13050 Gremoor Dr., Elm Grove, Wis. 53122-1815

[21] Appl. No.: 579,594

[22] Filed: Dec. 27, 1995

[51] Int. Cl.[6] ..... A63B 53/14; A63B 69/36

[52] U.S. Cl. ..... 473/203; 473/303

[58] Field of Search ..... 473/201, 203, 473/206, 302, 303

[56] References Cited

U.S. PATENT DOCUMENTS

| | | | |
|---|---|---|---|
| 2,141,519 | 12/1938 | Cunningham | 473/203 |
| 2,321,773 | 6/1943 | Ruemelin | 473/201 |
| 3,111,322 | 11/1963 | English | 473/201 |
| 3,860,243 | 1/1975 | Prisco | 473/206 |
| 4,065,127 | 12/1977 | Fagan | 473/201 |
| 4,376,536 | 3/1983 | Martin | 473/203 |
| 4,785,495 | 11/1988 | Dellis | 473/203 |
| 4,836,544 | 6/1989 | Lai | 473/203 |
| 4,867,453 | 9/1989 | Michael | 473/203 |
| 5,143,375 | 9/1992 | Wilkins | 273/165 |

OTHER PUBLICATIONS

The Golf Works, Ralph Maltby Enterprises, Inc., 1995, pp. 4–16, 4–17.

*Primary Examiner*—Sebastiano Passaniti

*Attorney, Agent, or Firm*—Nilles & Nilles

[57] ABSTRACT

A putter grip has at least one and preferably two stabilizing members each at least selectively extending generally radially outwardly from one of the front and rear surfaces of the body of the grip and each presenting a bottom surface which is designed to be engaged by a finger of a golfer. The stabilizing members help assure that the golf club will not twist or turn during a putting stroke and thus enhance the ability of a golfer to strike the ball squarely and to drive it along the intended line of travel. In the preferred case in which two stabilizing members are employed, one is preferably located slightly below the level of the other, and the bottom surfaces of both are curved so as to maximize comfort to the user. In a first preferred embodiment, the stabilizing members are molded integrally with the body of the grip. In a second preferred embodiment, the stabilizing members are pivotally attached to the body and are movable from a retracted, storage position to a raised, operative position.

18 Claims, 2 Drawing Sheets

PUTTER GRIP WITH STABILIZING MEMBERS

BACKGROUND OF THE INVENTION

1. Field of the Invention

The invention relates to golf putter grips, and more particularly, to putter grips having stabilizing members designed to inhibit a putter from twisting or turning during a putting stroke.

2. Discussion of The Related Art

One of the most important, if not the most important, part of any golfer's game is the ability to make putts accurately and with constancy. Indeed, when one considers that putting strokes typically account for one-half or more of a golfer's strokes, the age old expression "drive for show, putt for dough" becomes quite apt. It is therefore of little surprise that golfers and golf equipment manufacturers for some time have striven to produce putters which aid golfers in consistently striking the ball on the intended line and with the intended hardness. Most such designs deal with the composition and/or configuration of the putter head. Accordingly, oversized putter heads, specially-shaped putter heads, putter heads with arrows and crosses, and putter heads made of brass and other materials designed to improve the "feel" of the putting stroke have all been proposed.

A few attempts have also been made to improve the putting stroke through improved shaft or grip design. Most notably, the so called "long shafted" putter, having an unusually long shaft, has gained increased acceptance in recent years as a mechanism for improving putting accuracy.

One problem experienced by many golfers, and particularly high handicappers, is the inability to hit the ball squarely. Even if a golfer having this problem manages to properly initially align the face of the putter with the ball, he or she has a tendency to twist or turn the club face either in or out during the putting stroke, causing the ball to veer away from its intended line after it is struck. This problem is especially evident in so-called mid-range putts in the range of 3–10 feet in which many golfers have a tendency to rush their putt and to look up before they should so that they can follow the path of the ball towards the hole. Mechanisms designed to help golfers align the putter with the ball and/or to improve the feel of the putting stroke do little if anything to alleviate this problem.

OBJECTS AND SUMMARY OF THE INVENTION

It is therefore a primary object of the invention to provide an improved putter grip which enhances a golfer's ability to make a putting stroke without twisting or turning the club face and which therefore facilitates driving the ball along the intended line of travel.

Another primary object of the invention is to provide an improved putter grip which has the advantages described above, which requires minimal modification to existing putter grip designs, and which requires no modifications to existing shaft designs.

In accordance with a first aspect of the invention, these objects are achieved by providing a putter grip which includes an elongated molded body and at least one stabilizing member. The body is generally cylindrical in shape so as to have a longitudinal axis and is dimensioned to fit over an end of a putter shaft. The body has an upper end which is at least partially closed, an open lower end, and front and rear surfaces each extending from the lower end to the upper end. The stabilizing member is located between the lower and upper ends of the body. The stabilizing member at least selectively extends generally radially outwardly from one of the front and rear surfaces of the body and presents a bottom surface which is designed to be engaged by a finger of a golfer when gripping the grip.

Preferably, in order to provide maximum stability during a putting stroke, the stabilizing member is a first stabilizing member and at least selectively extends from the front surface of the body. In this case, the grip further comprises a second stabilizing member disposed in a common vertical plane with the first stabilizing member and at least selectively extending generally radially outwardly from the rear surface of the body. The second stabilizing member presents a bottom surface which is designed to be engaged by another finger of the golfer when gripping the grip.

Still another primary object of the invention is to provide a putter grip having one or more of the advantages described above and which is ergonomically designed to maximize comfort to the golfer and avoid interference with an otherwise standard putting grip.

In accordance with another aspect of the invention, the second stabilizing member is located below the first stabilizing member. In addition, the bottom surface of the stabilizing members are concave to conform generally to the shape of the finger.

A secondary object of the invention is to provide a putter grip which achieves one or more of the primary objects discussed above and the stabilizing members of which can be formed integrally with the remainder of the grip during molding such that no post-molding grip assembly is required.

In accordance with yet another aspect of the invention, this object is achieved by forming the stabilizing member integral with the body, preferably by molding.

Another secondary object of the invention is to provide a putter grip which meets one or more of the primary objects described above and the stabilizing members of which are retractable from a raised, operative position, to a lowered, storage position thereby facilitating putter storage in a golf bag and permitting the grip to be used in the conventional manner, if desired.

In accordance with yet another aspect of the invention, this object is achieved by providing a stabilizing member which is pivotal from a first, storage position in which it extends generally parallel with respect to the longitudinal axis to a second, operative position in which it extends generally radially outwardly from the body.

Yet another primary object of the invention is to provide a putter the grip of which has one or more of the advantages discussed above.

In accordance with still another aspect of the invention, this object is achieved by providing a putter comprising a head, a shaft, and a grip. The head has a heel, a toe, and a striking face. The shaft has a lower end attached to the head between the heel and the toe thereof and has an upper end located above the lower end. The grip includes an elongated molded body and first and second generally planar stabilizing members. The body is generally cylindrical in shape so as to have a longitudinal axis and which is mounted over the upper end of the shaft, the grip including a body. The body has an upper end which is at least partially closed, an open lower end, front and rear surfaces which are located in a common plane with the toe and the heel of the head and which extend from the lower end to the upper end, and a pair of side surfaces each extending from the lower end to the upper end. The stabilizing members are located between the lower and upper ends of the body in a common vertical plane with the heel of the head and the toe of the head. The first stabilizing member at least selectively extends generally radially forwardly from the front surface of the body and presents a bottom surface which is designed to be engaged by a first finger of a golfer when gripping the grip. The second stabilizing member at least selectively extends generally radially rearwardly from the rear surface of the body and presents a bottom surface which is designed to be engaged by another finger of the golfer when gripping the grip. The second stabilizing member is located below the first stabilizing member.

Other objects, features, and advantageous of the present invention will become apparent to those skilled in the art from the following detailed description and the accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

Preferred exemplary embodiments of the invention are illustrated in the accompanying drawings in which like reference numerals represent like parts throughout, and in which.

DETAILED DESCRIPTION OF A PREFERRED EMBODIMENT

1. Resume

Figure 1:
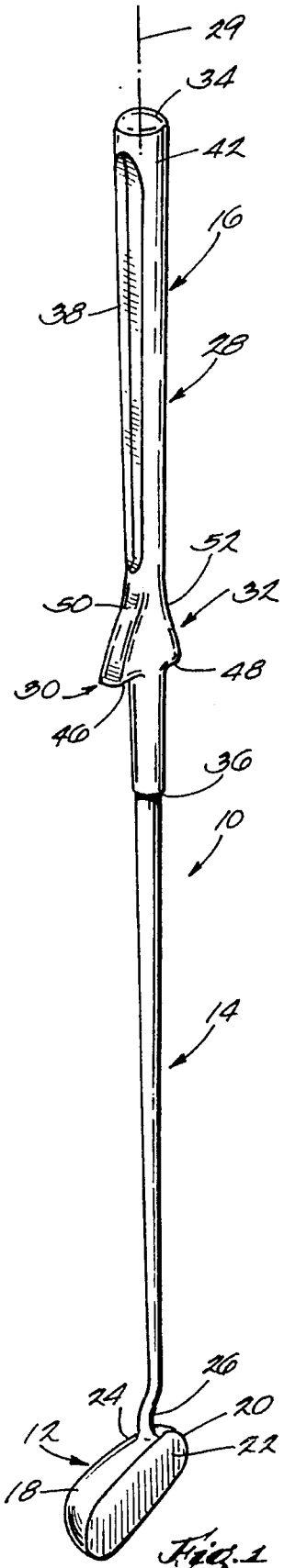
FIG. 1 is a perspective view of a putter incorporating a grip constructed in accordance with a first preferred embodiment of the present invention.

Pursuant to the invention, a putter grip is provided which has at least one and preferably two stabilizing members each at least selectively extending generally radially outwardly from one of the front and rear surfaces of the body of the grip and each presenting a bottom surface which is designed to be engaged by a finger of a golfer. The stabilizing members help assure that the golf club will not twist or turn during a putting stroke and thus enhance the ability of a golfer to strike the ball squarely and to drive it along the intended line of travel. In the preferred case in which two stabilizing members are employed, one is preferably located slightly below the level of the other, and the bottom surfaces of both are curved so as to maximize comfort to the user. In a first preferred embodiment, the stabilizing members are molded integrally with the body of the grip. In a second preferred embodiment, the stabilizing members are pivotally attached to the body and are movable from a retracted, storage position to a raised, operative position.

2. Construction and Operation of First Embodiment

Referring now to FIGS. 1–4, a putter 10 is illustrated which is conventional in construction except for incorporating a grip constructed in accordance with a first embodiment of the invention. The putter 10 thus includes a head 12, a shaft 14, and a grip 16.

The head 12 may be any commercially available putter head formed from aluminum, brass, or any other material commonly used in putter heads. As is conventional, the head includes a front toe 18, a rear heel 20, a flat striking face 22 designed to engage the ball, and a top surface 24.

The shaft 14 is also conventional and may be formed from a steel tube as illustrated or from graphite or any other material commonly used in shafts. The shaft 14 has an upper end which is covered by the grip 16 and a lower end 26 which is attached to the top 24 of the head 12. The shaft 14 is generally cylindrical and thus has a longitudinal axis 29 but, as is standard, is tapered slightly from its upper end to its lower end 26.

The grip 16 includes an elongated molded body 28 and first and second stabilizing members 30, 32. The body 28, though tapered to conform to the shape of the shaft 14, is generally cylindrical in shape and is coaxial with the shaft 14 so as to present the longitudinal axis 29. The body 28 may be molded from natural rubber, silicon rubber, or any other material commonly used in putter grips. The body 28 has an upper end 34 which is fully or partially closed either by an end portion molded integrally with the remainder of the body or by a cap or plug capable of fitting onto or into the upper end of the shaft 14. The body 28 further includes a lower end 36 which is open so as to be capable of sliding over the shaft 14. Although the body 28 is generally cylindrical and, accordingly, strictly speaking presents a singular circular surface when viewed in cross-section, it may be thought of as having front and rear surfaces 38 and 40 each extending through an arc of about 90° and aligned with the toe 18 and heel 22 of the head 12, respectively, and as having opposed side surfaces 42, 44 connecting the front and rear surfaces 38 and 40 to one another. Each of the surfaces 38, 40, 42, and 44 extends from the lower end 36 of the body 28 to the upper end 34.

The grip 16 as thus far described as conventional. Pursuant to the invention, however, the grip 16 is provided with first and second stabilizing members 30, 32 dimensioned and configured to permit the user to engage bottom surfaces 46, 48 of the stabilizing members 30, 32 with his or her fingers in use. The stabilizing members 30, 32 extend generally radially from the front and rear surfaces 38 and 40 of the body 28 so as to be located in a common vertical plane with the heel 18 and the toe 20 of the head 12. The illustrated stabilizing members 30, 32 are molded integrally with the body 28. Standard grip materials should provide sufficient rigidity so that each stabilizing member 30, 32 can be molded entirely from the same material as the body illustrated in FIG. 4. However, if the grip material proves insufficiently rigid in certain applications, metal, rigid plastic, or other rigid inserts could be molded into the stabilizing members 30, 32 during the molding process.

It is contemplated that the user will engage the first or forward stabilizing member 30 with his or her index finger and the second or rear stabilizing member 32 with the middle finger. Because the middle finger is substantially longer then the index finger, the second or rear stabilizing member 32 is preferably located ⅛" to ½", and preferably about ¼", below the level of the first stabilizing member 30. Both stabilizing members are located on the portion of the grip 16 in which the golfer's right hand would normally grasp the grip in use, i.e. 2–4", and preferably about 2½" from the lower end 36 of the body 28. Of course, if the putter is designed for use by a left-handed golfer, the stabilizing members would be positioned for engagement by the left hand. The location of the stabilizing members relative to the bottom of the grip would be the same, but the relative orientation of the first and second stabilizing members would be reversed.

Figure 2:
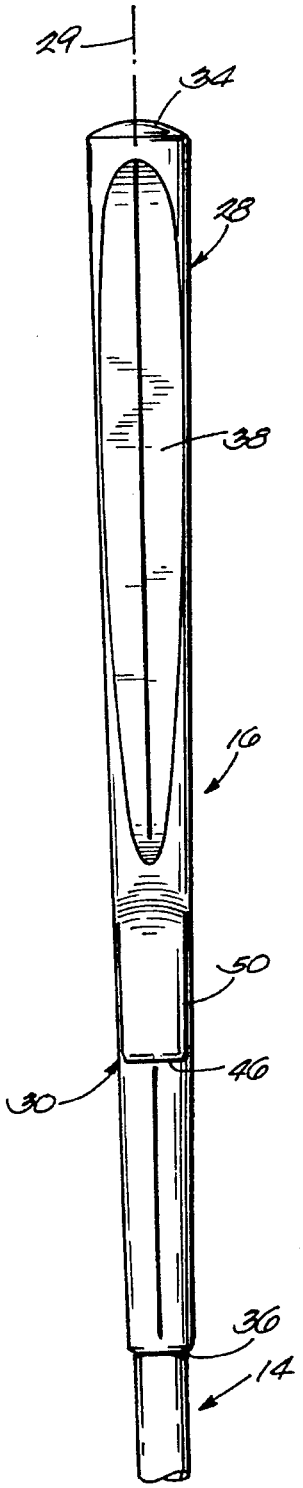
FIG. 2 is a front elevation view of the grip and accompanying portion of the shaft of the putter of FIG. 1.
Figure 3:
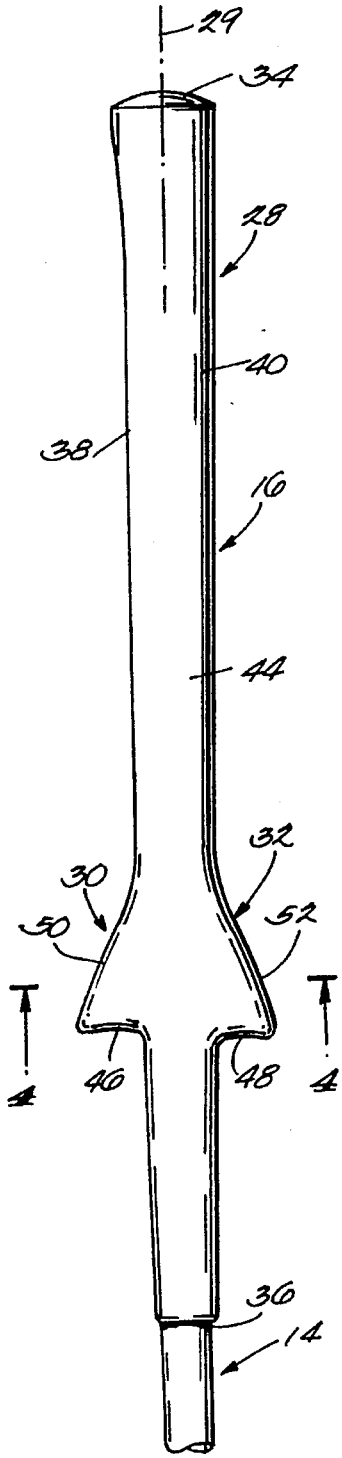
FIG. 3 is a side elevation view of the grip and shaft portion of FIG. 2.

In the illustrated embodiment, each stabilizing member 30, 32 1) is generally triangular in shape when viewed from the side as illustrated in FIG. 3 and 2) therefore has the previously-described bottom surface 46, 48 and an outside surface 50, 52 (the inside surface being formed integrally with the body 28). This configuration is not only aesthetically appealing but also, because of the orientation of the outside surface 50, 52, will inhibit the stabilizing member 30, 32 from snagging on the lip, support mesh, or support tubes of a golf bag when it is being inserted into the bag. The bottom surface 46, 48 of each stabilizing member 30, 32 should be sufficiently long to permit the golfer's fingers to engage it with comfort. Thus, the bottom surface 46, 48 should have a radial length of about ½" to 1", and preferably about ¾" to ⅞". The bottom surface 46, 48 is also preferably concave in profile to conform to the shape of the user's finger and to enhance user comfort. The outside surface 50, 52 is preferably about 2½" long. Finally, each stabilizing member 30, 32 should have a thickness which is no greater than, and preferably about the same as, the diameter of the body 28 at the location of the stabilizing member 30 or 32, thereby to facilitate insertion of the putter 10 in a golf bag and to further maximize user comfort.

In use, when a golfer is preparing to make a putt, he or she aligns the club face 22 of the putter 10 with the ball in the conventional manner. He or she then grasps the grip 16 with the left hand in the conventional manner and with the right hand in a manner which is for the most part conventional. However, rather than wrapping the index and middle fingers around the grip 16 as would be standard, the golfer engages the bottom surfaces 46, 48 of the first and second stabilizing members 30, 32 with those fingers. Gripping the club 10 in this manner is considerably enhanced by 1) the concave shape of the bottom surfaces 46, 48 of the stabilizing members 30, 32, 2) the longitudinal location of the stabilizing members 30, 32 on the portion of the grip 16 in which these fingers normally would be located, and 3) the location of the second stabilizing member 32 slightly beneath the first stabilizing member 30 so as to accommodate the golfer's longer middle finger. It has been found that gripping the putter 10 in this manner unexpectedly inhibits or even prevents the golfer from twisting or turning the club face 22 in or out during the putting stroke and greatly enhances the golfer's ability to drive the ball along its intended travel path. It is believed that the stabilizing members 30, 32 achieve this result much more effectively then grooves, furrows, or other irregularities in the surface of grips designed to improve a golfer's hold on the grip. Moreover, unlike grooves, etc., and except for providing a new point of engagement for two of the golfer's fingers, the golfer is free to grasp the grip 16 in any way he or she desires with comfort and without interference from the surface of the grip 16.

Of course, the primary stabilizing benefits of the invention can be achieved using stabilizing members of radically different designs then that described and illustrated above. One such alternative design will now be detailed.

3. Construction and Operation of Second Embodiment

Although the stabilizing members discussed above are preferred because they can be formed with the remainder of the grip in a single molding step, it may in some markets be desirable to provide retractable stabilizing members. A grip having retractable stabilizing members, though more difficult to manufacture and thus more expensive then a grip having molded and immovable stabilizing members, may be considered advantageous to some because 1) the stabilizing members can be retracted into a storage position in which they can in no way hinder insertion or removal of a golf club into or from a golf bag and, 2) it can selectively permit a single putter to be used both in a conventional manner in which the golfer's index and middle fingers are wrapped around the grip and in the manner described above in which the golfer's middle and index fingers engage the stabilizing members.

Figure 5:
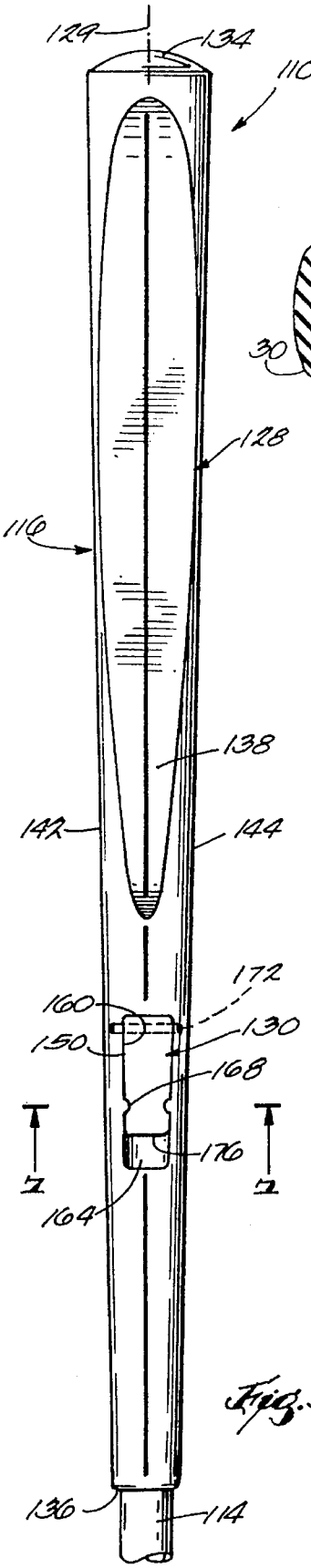
FIG. 5 is a front elevation view of the grip and accompanying shaft portion of a putter employing a grip constructed in accordance with a second preferred embodiment of the invention and illustrating the stabilizing members of the grip in a retracted or storage position.
Figure 4:
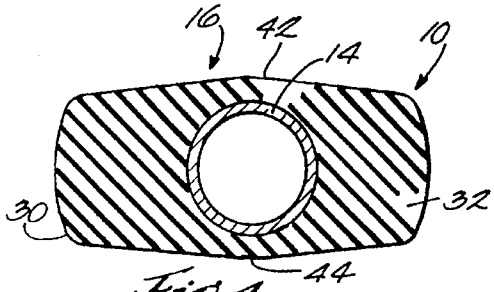
FIG. 4 is a sectional plan view taken along the lines 4—4 in FIG. 3.
Figure 7:
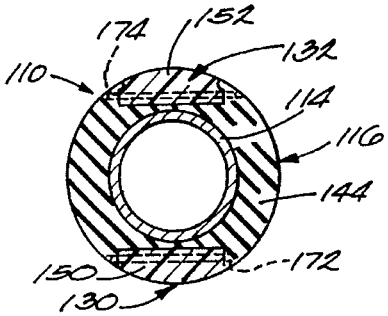
FIG. 7 is a sectional plan view taken along the lines 7—7 in FIG. 5.
Figure 6:
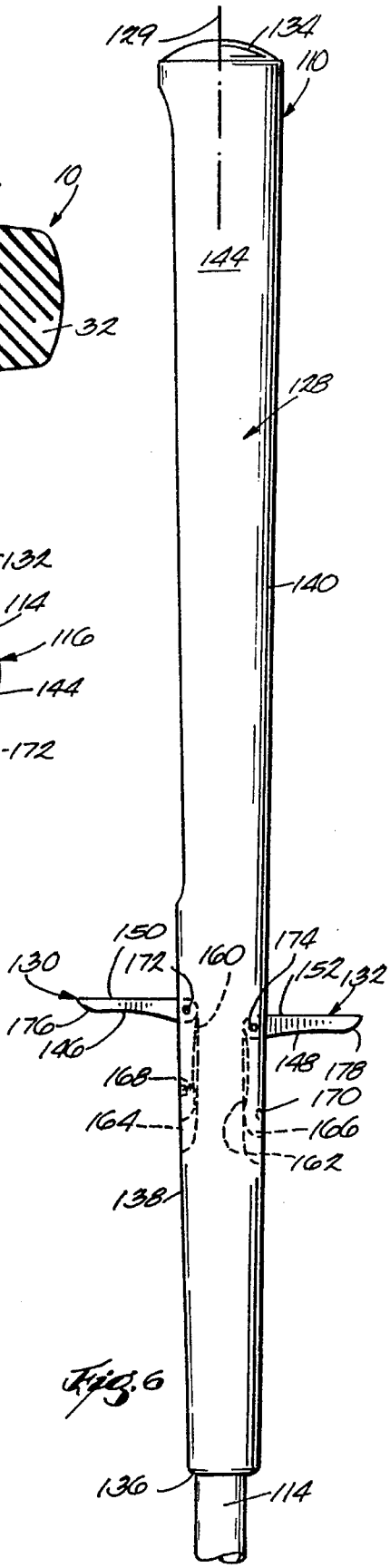
FIG. 6 is a side elevation view of the grip and shaft portion of FIG. 5, illustrating the stabilizing members in an extended or operative position.

Toward this end, referring to FIGS. 5–7, a grip 116 and accompanying portion of a shaft 114 of a putter 110 are illustrated in which the putter 110, including the shaft 114 and grip 116, are identical to the putter 10 of the first embodiment except for incorporating different stabilizing members. Elements of the putter 110 of FIGS. 5–7 corresponding to elements of the putter 10 of FIGS. 1–4 are, accordingly, designated by the same reference numerals, incremented by 100. The club 110 thus includes a head (not shown) a tapered shaft 114, and a grip 116.

The grip 116 includes 1) a molded generally cylindrical body 128 and 2) first and second stabilizing members 132, 134. The molded body 128, like the body 28 of the first embodiment, has a closed upper end 134, an open lower end 136, and is generally cylindrical in shape so as to present a longitudinal axis 129 and front, rear and side surfaces 138, 140, 142, and 144.

The body 128 differs from the body 28 of the first embodiment only in that it is designed to receive separate retractable stabilizing members 130, 132 rather then having the stabilizing members formed integrally therewith. The body 128 therefore has recesses 160, 162 formed in the front and rear surfaces 138, 140 thereof which are dimensioned to receive the stabilizing members 130, 132. The upper end of the front recess 160 is located about 2½" above the lower end 136 of the body 128, and the upper end of the rear recess 162 is located about 2¼" above the lower end 136 of the body 128. Each recess 160, 162 is only slightly wider and slightly deeper than the width and depth of the corresponding stabilizing member 130, 132 so as to permit the stabilizing members 130, 132 to pivot into a position within the recesses 160, 162 illustrated in FIGS. 5 and 7 and in phantom lines in FIG. 6, in which they are just slightly inside the level of the respective front and rear surface 138, 140 of the body 128. Each recess 160, 162 is substantially longer then the length of the stabilizing member 130, 132 (having a total length of ¾" to 1½") to present a finger catch 164, 166 beneath an end 176, 178 of the stabilizing member 130, 132 when the stabilizing member 130, 132 is in its retracted position.

In addition, small nubs or projections 168, 170 are molded into the body 128 so as to extend into the recess 160, 162 at the outer edge thereof. The nubs or projections 168, 170 form stops or latches which hold the stabilizing members 130, 132 in place when the stabilizing members 130, 132 are pivoted into their retracted or storage positions illustrated in FIGS. 5 and 7 and in phantom lines in FIG. 6.

Finally, a relatively small hole is drilled or otherwise formed into each side surface 140, 142 of the body 128 proximate the upper end of the recess 160, 162 so as to form a support for a pivot pin 172, 174.

The stabilizing members 130, 132, like the stabilizing members 30, 32 of the first embodiment, are generally planer and are located in the same vertical plane as the toe and heel of the putter head (not shown). The stabilizing members 130, 132 extend generally radially from the respective surfaces 138, 140 of the body 128 when in their extended or operative positions illustrated in solid lines in FIG. 6. The amount of this extension is preferably about ½" to 1", and more preferably about ¾" to ⅞". Also as in the first embodiment, the stabilizing members 130, 132 each have 1) a concave bottom surface 146, 148 which is designed to conform in shape to the surfaces of a golfer's fingers and 2) an upper or outer surface 150, 152. However, unlike in the first embodiment, the stabilizing members 130, 132, are made from a relatively rigid plastic material and are relatively flat, having an average thickness of about ¼ or less. A bore is formed through the upper end of each stabilizing member 130, 132 to receive the associated pivot pin 172, 174. A lower or outer end 176, 178 of each stabilizing member is curved or tapered to facilitate insertion of a user's fingernail therebeneath when the stabilizing members need to be removed from the storage or retracted positions illustrated in FIGS. 5 and 7 and in phantom lines in FIG. 6.

In use, the stabilizing members 130, 132 are stored, transported, and, if desired, used in their retracted or storage positions illustrated in FIGS. 5 and 7 and in phantom lines in FIG. 6 in which the stabilizing members 130, 132 are pivoted into the corresponding recesses 160, 162 in the body 128 and are held in place by the nubs or projections 168, 170 formed on the body 128. As can be seen best in FIG. 7, the outer surface 150, 152 of each stabilizing member 130, 132 is preferably dimensioned and configured so as to generally conform to the shape of the corresponding surface of the body 128 so that, if desired, the putter 110 can be gripped and used in a conventional manner with the stabilizing members 130, 132 retracted with little or no interference from the stabilizing members.

Assuming now that a golfer wishes to use the stabilizing members 130, 132 to improve his or her putting stroke, he or she simply slips a finger into the finger catch 164, 166 and under the lower or outer end 176, 178 of the stabilizing member 130, 132. The stabilizing members 130, 132 can then be pivoted by the user's finger, against the relatively small resistance provided by the nubs or projections 168, 170, into the position illustrated in solid lines in FIG. 6 in which the stabilizing members 130, 132 extend generally radially or horizontally from the body 128 of the grip 116. Pivotal motion of the stabilizing members 130, 132 beyond this position is prevented by engagement of the outer surface 150, 152 with the upper end wall of the corresponding recess 160, 162. If desired, the stabilizing members 130, 132 can engage the side walls of the recesses 160, 162 with a slight friction fit when they are pivoted into this position so as to inhibit them from falling back into their retracted or storage positions. It is also conceivable that, in a particularly sophisticated embodiment, a torsion spring or the like could be provided at the interface between each stabilizing member 130, 132 and the corresponding pivot pin 172, 174 and body 128 to bias the stabilizing member 130, 132 into its extended or operative position. In a particularly simple and inexpensive embodiment, no mechanism whatsoever need be provided to maintain the stabilizing members 130, 132 in their extended or operative positions, it being envisioned that the golfer's fingers will perform this function during the putting stroke and it being further envisioned that the nubs or projections 168, 170 will prevent the stabilizing members 130, 132 from unintentionally falling back into the storage position illustrated in FIGS. 5 and 7 and in phantom lines in FIG. 6.

The golfer is now free to perform a putting stroke, using the stabilizing members 130, 132 to inhibit or prevent putter head from twisting and turning just as the stabilizing members 130, 132 of the first embodiment inhibit or prevent the putter head 12 from twisting or turning. After the golfer is finished with the putter 110, he or she simply pushes the stabilizing members 130, 132 back into the recesses 160, 162, against slight resistance from the nubs or projections 168, 170, thereby returning the stabilizing members 130, 132 to their retracted or storage positions illustrated in FIGS. 5 and 7 and in phantom lines in FIG. 6. The stabilizing members 130, 132 are held in this position by the nubs or projections 168, 170 until the next intended use.

Of course, many modifications could be made to the invention as described and illustrated without departing from the spirit of the present invention. For instance as discussed above, the stabilizing members could be used with virtually any putter configuration. Moreover, the stabilizing members need not be of the size or configuration described above, and their locations relative to the end of the grip could be varied. The scope of such changes will become apparent from the appended claims.

I claim:

1. A putter grip comprising:

(A) an elongated molded body which is generally cylindrical in shape so as to have a longitudinal axis and which is dimensioned to fit over an end of a putter shaft, said body having (1) an upper end which is at least partially closed, (2) an open lower end, and (3) front and rear surfaces each extending from said lower end to said upper end;

(B) a first stabilizing member located between said lower and upper ends of said body, said first stabilizing member at least selectively extending generally radially outwardly from said front surface of said body and presenting a bottom surface which is designed to be engaged by a first finger of a golfer when gripping said grip; and (C) a second stabilizing member disposed at least substantially in a common vertical plane with said first stabilizing member and at least selectively extending generally radially outwardly from said rear surface of said body, said second stabilizing member presenting a bottom surface which is designed to be engaged by another finger of said golfer when gripping said grip.

2. A grip as defined in claim 1, wherein said second stabilizing member is located below said first stabilizing member.

3. A grip as defined in claim 1, wherein each said stabilizing member is formed integral with said body.

4. A putter grip comprising:

(A) an elongated molded body which is generally cylindrical in shape so as to have a longitudinal axis and which is dimensioned to fit over an end of a putter shaft, said body having (1) an upper end which is at least partially closed, (2) an open lower end, and (3) front and rear surfaces each extending from said lower end to said upper end; and (B) a stabilizing member located between said lower and upper ends of said body, said stabilizing member at least selectively extending generally radially outwardly from one of said front and rear surfaces of said body and presenting a bottom surface which is designed to be engaged by a finger of a golfer when gripping said grip, wherein said stabilizing member is pivotal from a first, storage position in which it extends generally parallel with respect to said longitudinal axis to a second, operative position in which it extends generally radially outwardly from said body.

5. A grip as defined in claim 1, wherein said bottom surface of each said stabilizing member is concave to conform generally to the shape of one of said fingers.

6. A putter grip comprising:

(A) an elongated molded body which is generally cylindrical in shape so as to have a longitudinal axis and which is dimensioned to fit over an end of a putter shaft, said body having (1) an upper end which is at least partially closed, (2) an open lower end, (3) front and rear surfaces each extending from said lower end to said upper end, and (4) a pair of side surfaces each extending from said lower end to said upper end; and (B) first and second generally planar stabilizing members located between said lower and upper ends of said body, said first stabilizing member at least selectively extending generally radially outwardly from said front surface of said body and presenting a bottom surface which is designed to be engaged by a first finger of a golfer when gripping said grip, said second stabilizing member at least selectively extending generally radially outwardly from said rear surface of said body and presenting a bottom surface which is designed to be engaged by another finger of said golfer when gripping said grip, said second stabilizing member being located below said first stabilizing member.

7. A grip as defined in claim 6, wherein said bottom surfaces of said stabilizing members are concave to conform generally to the shape of said fingers.

8. A grip as defined in claim 6, wherein said first stabilizing member is located between about 2" and about 4" from said bottom end of said grip and said second stabilizing member is located between about ⅛" and about ½" below said first stabilizing member.

9. A grip as defined in claim 6, wherein each of said first and second stabilizing members has a radial length of between about ½" and about 1".

10. A grip as defined in claim 9, wherein each of said first and second stabilizing members has a radial length of between about ¾" and about ⅞".

11. A grip as defined in claim 6, wherein each of said first and second stabilizing members has a thickness which is no thicker than then the widths of said side surfaces of said body.

12. A grip as defined in claim 6, wherein each of said stabilizing members is molded into said body and is generally triangular in shape.

13. A grip as defined in claim 6, wherein each of said stabilizing members is pivotal from a first, storage position in which it extends generally parallel with said longitudinal axis to a second, operative position in which it extends generally radially outwardly from said body.

14. A putter grip comprising:

(A) an elongated molded body which is generally cylindrical in shape so as to have a longitudinal axis and which is dimensioned to fit over an end of a putter shaft, said body having (1) an upper end which is at least partially closed, (2) an open lower end, (3) from and rear surfaces each extending from said lower end to said upper end, and (4) a pair of side surfaces each extending from said lower end to said upper end; and (B) first and second generally planar stabilizing members located in a common vertical plane, each of said first and second stabilizing members 1) being located between said lower and upper ends of said body, 2) being formed integral with said body, and 3) extending generally radially outwardly from said front surface of said body by a distance of between about ½" and about 1", said first stabilizing member presenting a concave bottom surface which is designed to be engaged by a first finger of a golfer when gripping said grip, and said second stabilizing member being located about ⅛" to ½" below said first stabilizing member and presenting a concave bottom surface which is designed to be engaged by a second finger of said golfer when gripping said grip.

15. A grip as defined in claim 14, wherein said first and second stabilizing members are formed entirely from the same material as said body.

16. A putter grip comprising:

(A) an elongated molded body which is generally cylindrical in shape so as to have a longitudinal axis and which is dimensioned to fit over an end of a putter shaft, said grip including a body, said body having (1) an upper end which is at least partially closed, (2) an open lower end, (3) front and rear surfaces each extending from said lower end to said upper end, and (4) a pair of side surfaces each extending from said lower end to said upper end, wherein first and second recesses are formed in said body between said upper and lower ends thereof; and (B) first and second stabilizing members, each of said first and second stabilizing members 1) being located between said lower and upper ends of said body, 2) being pivotally attached to said body, and 3) being pivotal from a first, storage position in which it extends generally parallel with said body and is received in one of said recesses to a second, operative position in which it extends generally radially outwardly from said body of a distance of between about ½" and about 1", said first stabilizing member presenting a concave bottom surface which is designed to be engaged by a first finger of a golfer when gripping said grip and when said first stabilizing member is in said operative position, and said second stabilizing member being located about ⅛" to ½" below said first stabilizing member and presenting a concave bottom surface which is designed to be engaged by a second finger of said golfer when gripping said grip and when said second stabilizing member is in said operative position.

17. A grip as defined in claim 16, wherein said recesses are longer than said stabilizing members so as to define finger catches which are spaced longitudinally between ends of said stabilizing members and lower ends of said recesses when said stabilizing members are in said storage positions, said stabilizing members have an average thickness which is less than a depth of said recesses, and wherein said body further comprises projections which are molded thereon, which extend into said recesses near outer edges thereof, and which act as latches to hold said stabilizing members in position when said stabilizing members are in said storage position.

18. A putter comprising:

(A) a head having a heel, a toe, and a striking face;

(B) a putter shaft having a lower end attached to said head between said heel and said toe thereof and having an upper end located above said lower end; and (C) a grip which includes (1) an elongated molded body which is generally cylindrical in shape so as to have a longitudinal axis and which is mounted over said upper end of said shaft, said grip including a body, said body having (a) an upper end which is at least partially closed, (b) an open lower end, (c) front and rear surfaces which are located in a common plane with said toe and said heel of said head and which extend from said lower end to said upper end, and (d) a pair of side surfaces each extending from said lower end to said upper end; and (2) first and second generally planar stabilizing members located between said lower and upper ends of said body in a common vertical plane with said heel of said head and said toe of said head, said first stabilizing member at least selectively extending generally radially forwardly from said front surface of said body and presenting a bottom surface which is designed to be engaged by a first finger of a golfer when gripping said grip, said second stabilizing member at least selectively extending generally radially rearwardly from said rear surface of said body and presenting a bottom surface which is designed to be engaged by another finger of said golfer when gripping said grip, said second stabilizing member being located below said first stabilizing member.

* * * * *